US010898919B2

(12) United States Patent
Frank et al.

(10) Patent No.: US 10,898,919 B2
(45) Date of Patent: Jan. 26, 2021

(54) COATING APPARATUS AND METHOD FOR COATING OF CYLINDRICAL HOLLOW BODIES

(71) Applicant: Hinterkopf GmbH, Eislingen/Fils (DE)

(72) Inventors: Martin Frank, Uhingen-Holzhausen (DE); Joachim Weber, Bad Ditzenbach (DE)

(73) Assignee: HINTERKOPF GMBH, Eislingen/Fils (DE)

( * ) Notice: Subject to any disclaimer, the term of this patent is extended or adjusted under 35 U.S.C. 154(b) by 26 days.

(21) Appl. No.: 16/353,688

(22) Filed: Mar. 14, 2019

(65) Prior Publication Data

US 2019/0283068 A1 Sep. 19, 2019

(30) Foreign Application Priority Data

Mar. 15, 2018 (EP) ..... 18161893

(51) Int. Cl.

| | |
|---|---|
| ***B05C 1/02*** | (2006.01) |
| ***B05C 5/02*** | (2006.01) |
| ***B05D 1/28*** | (2006.01) |
| ***B05C 13/02*** | (2006.01) |
| ***B05C 1/08*** | (2006.01) |

(52) U.S. Cl.

CPC ..... *B05C 1/022* (2013.01); *B05C 5/0241* (2013.01); *B05C 13/025* (2013.01); *B05D 1/28* (2013.01); *B05C 1/0808* (2013.01)

(58) Field of Classification Search

CPC ..... B05C 1/022; B05C 13/025; B05C 5/0241; B05C 1/0808; Y10S 118/14; Y10S 118/15; B05D 1/28; B41F 17/22

USPC ..... 118/206

See application file for complete search history.

(56) References Cited

U.S. PATENT DOCUMENTS 2,015,669 A * 10/1935 Gravely ..... B41F 17/22 101/40.1

3,630,140 A * 12/1971 Marrie ..... A21B 5/03 99/423

FOREIGN PATENT DOCUMENTS

| | | |
|---|---|---|
| EP | 2868477 A1 | 5/2015 |
| EP | 3088090 A1 | 11/2016 |
| EP | 3156242 A1 | 4/2017 |

* cited by examiner

*Primary Examiner* — Laura Edwards

(74) *Attorney, Agent, or Firm* — Hoffmann & Baron, LLP

(57) ABSTRACT

Coating apparatus for coating cylindrical hollow bodies, having a machine frame and a workpiece rotary table which is equipped with a plurality of holding mandrels mounted rotatably on the workpiece rotary table, and having a coating station arranged on the machine frame, wherein the coating station includes a rotatably mounted coating roller, wherein axes of rotation of the holding mandrels and an axis of rotation of the coating roller are aligned parallel to one another, wherein the coating roller has a coating region and a free-wheeling region on a circumferential surface, the coating region being designed as a circular cylinder segment with a constant circular radius coaxial with the axis of rotation of the coating roller, and the free-wheeling region being formed from surface sections which each have a distance from the axis of rotation of the coating roller which is smaller than the circular radius.

15 Claims, 5 Drawing Sheets

COATING APPARATUS AND METHOD FOR COATING OF CYLINDRICAL HOLLOW BODIES

BACKGROUND OF THE INVENTION

The invention concerns a coating apparatus for coating cylindrical hollow bodies, with a machine frame and a workpiece rotary table mounted on the machine frame so that it can rotate about a rotary axis, which is equipped with several holding mandrels which are rotatably mounted on the workpiece rotary table and which are designed to hold cylindrical hollow bodies, as well as with a coating station arranged on the machine frame. The invention also concerns a process for coating cylindrical hollow bodies.

From the EP 3 088 090 A1 a coating device for coating an outer surface of a coating object is known, comprising a dispensing device for providing a continuous or discontinuous coating stream and a receiving device for receiving and positioning a coating object opposite to the dispensing device, wherein said dispensing means comprises a dispensing nozzle and a coating conveying means fluidly communicating with said dispensing nozzle, said coating conveying means being adapted for pressurized delivery of coating to said dispensing nozzle, and wherein said coating conveying means is adapted for providing hydrostatic pressure to said coating and said exit nozzles are adapted for dispensing coating filaments in response to hydrostatic pressure to said coating.

SUMMARY OF THE INVENTION

The task of the invention is to provide a coating apparatus with which a cost-effective coating of an outer surface of a cylindrical hollow body can be realized.

This task is solved for a coating apparatus having a machine frame and a workpiece rotary table which is mounted on the machine frame so as to be rotatable about an axis of rotation and which is equipped with a plurality of holding mandrels which are each rotatably mounted on the workpiece rotary table and which are designed to receive cylindrical hollow bodies, and with a coating station arranged on the machine frame, wherein the coating station comprises a coating roller which is rotatably mounted on the coating station, wherein an axis of rotation of the holding mandrel and an axis of rotation of the coating roller are aligned parallel to one another, the coating roller having a coating region and a free-wheeling region on a circumferential surface, the coating region being a circular cylinder segment with a constant circular radius and is coaxial with the rotational axis of the coating roller and wherein the free-wheeling region is formed from surface sections which each have a distance from the rotational axis of the coating roller which is smaller than the circular radius.

The task of the coating roller is to apply a coating on the outer surface of the cylindrical hollow body in the course of a rolling movement, in particular a slip-free rolling movement, of the coating area on the outer surface of the cylindrical hollow body which may be for example an aerosol can blank made of aluminium or a tube blank made of plastic. For this rolling movement, an opposite rotation of the cylindrical hollow body and the coating roller, which is held on the mandrel, is provided. It is also provided that the coating area of the coating roller is in contact with the outer surface of the cylindrical hollow body to allow a contact, preferably a line contact, between the coating area and the outer surface. On the other hand, it is provided that the free-wheeling region of the coating roller cannot come into physical contact with the outer surface of the cylindrical hollow body, which is achieved by the surface portions of the free-wheeling region having a distance from the axis of rotation of the coating roller smaller than the circular radius of the coating region formed as a circular cylinder segment. Preferably, the free-wheeling region is defined by all surface portions of the free-wheeling region being spaced from the axis of rotation of the coating roller by a distance smaller than the radius of the coating area.

The free-wheeling region serves in particular to enable a transport movement for the cylindrical hollow body, which is achieved by a rotary step movement of the workpiece rotary table relative to the machine frame, without any undesired contact between the coating roller and the outer surface of the cylindrical hollow body. Such an unwanted contact could lead to an uncontrolled application of coating to the outer surface of the cylindrical hollow body and/or to a disproportionate wear of the coating roller. As an example, the coating roller is designed with a constant profiling along its axis of rotation, in which the coating area in a cross-sectional plane aligned transversely to the axis of rotation corresponds to a circular arc section aligned concentrically to the axis of rotation and the free-wheeling region has a radial extension relative to the axis of rotation of the coating roller which is smaller than a radius of the coating area.

The rotary step movement of the workpiece rotary table typically comprises a sequence of acceleration of the workpiece rotary table from a rest state (in a coating position for at least one hollow body relative to the coating station) to a predeterminable maximum rotational speed and subsequent deceleration of the workpiece rotary table to a subsequent rest state, whereby at least one further (subsequent) hollow body is brought into the coating position relative to the coating station, and a predeterminable holding period which can be maintained during the rest state for carrying out the coating operation.

Provided that the rotary step movement is synchronized in a suitable manner with a—preferably provided—permanent rotation of the coating roller about the axis of rotation, it can be ensured that during the rotary step movement of the workpiece rotary table the coating roller is aligned with its free-wheeling region opposite to a plane of movement described by the cylindrical hollow bodies, so that no undesired contact occurs between the cylindrical hollow bodies and the coating roller independently of the rotary position of the workpiece rotary table.

Advantageous further embodiments of the invention are subject of the subclaims.

It is useful if the rotary axes of the mandrels and the rotary axis of the coating roller are aligned transversely to the rotary axis of the workpiece rotary table. The outer surfaces of the cylindrical hollow bodies thus determine a circular disk-shaped plane of motion, which is characterized by the fact that it represents the minimum distance of the outer surfaces of the cylindrical hollow bodies from the coating station, in particular from the axis of rotation of the coating roller. This minimum distance is dimensioned in such a way that it corresponds to the circular radius of the coating area of the coating roller, which is designed as a circular cylinder segment, with the exception of a coating gap dependent on the coating to be applied and the elasticity properties of the cylindrical hollow body and the coating roller, in particular the coating gap. This ensures an advantageous contact, in particular a line contact, between the hollow body and the coating area. A central axis of the circular movement plane is identical to the rotational axis of the workpiece rotary table. This makes it possible to achieve a favourable compromise with regard to the supply and discharge of cylindrical hollow bodies in the radial direction onto the holding mandrels or from the holding mandrels and a compact arrangement of at least one coating station on the machine frame opposite the workpiece rotary table.

In a further configuration of the invention, it is provided that holding mandrels arranged in pairs adjacent each other on the workpiece rotary table which are aligned parallel to each other and that the coating station comprises two coating rollers aligned parallel to each other, each of the coating rollers being aligned opposite one of the two holding mandrels in a coating position of the workpiece rotary table. The parallel alignment of the mandrels arranged adjacent to each other allows the cylindrical hollow bodies to be efficiently pushed onto the mandrels to be efficiently and pulled off from the mandrels respectively. Furthermore, the outer surfaces of the cylindrical hollow bodies can be machined at different work stations in a circumferential direction along a circular movement path for the cylindrical hollow bodies which is determined by the rotary step movement of the workpiece rotary table as well as a feed device for the cylindrical hollow bodies and a discharge device for the cylindrical hollow bodies. The arrangement of the two coating rollers of the coating station opposite each other to the holding mandrels arranged in pairs and aligned parallel to each other applies to the coating position of the workpiece rotary table during a holding period in which no rotational movement of the workpiece rotary table takes place. During this holding period, the outer surfaces of two cylindrical hollow bodies can be coated at the coating station with two coating rollers arranged opposite each other. It is particularly preferred that rotational movements of the parallel mandrels and thus also rotational movements of the parallel coating rollers are aligned in opposite directions. This allows an advantageous, in particular mirror-symmetrical, application of force from the coating rollers to the workpiece holders of the workpiece rotary table. Preferably, at least force components of the forces occurring when the respective coating areas of the coating rollers impinge on the associated outer surfaces of the hollow bodies are aligned mirror-symmetrically with respect to one another so that, at least with respect to these force components, a cumulative force on the workpiece rotary table disappears.

In the case of an advantageous further embodiment of the invention a distance between the axis of rotation of the mandrels arranged in pairs is smaller than a distance between the axis of rotation of the coating rollers aligned parallel to each other. The task of the coating rollers is usually to achieve a complete circumferential coating of the outer surface of the cylindrical hollow bodies. Accordingly, due to the segmentation of the circumferential surface of the coating roller into the coating area and the free-wheeling region, a length of an arc determined by the coating area must be at least equal to the circumference of the outer surface of the cylindrical hollow body. As a result, an envelope curve determined by the coating area around the respective coating roll, which is swept during rotation of the coating roll, must have a larger diameter than the cylindrical hollow body, so that the axes of rotation of the coating rolls aligned parallel to each other must have a distance that is bigger than a distance between the holding mandrels arranged in pairs.

It is preferred that the coating area of the coating roller covers an angular range of less than 270 degrees, preferably less than 240 degrees, especially preferred less than 210 degrees, especially less than 180 degrees. The coating area has to be matched to the outer surface of cylindrical hollow bodies in such a way that a complete circumferential coating of the outer surface of the cylindrical hollow body can be ensured by the coating roller. Furthermore, it is advantageous if a rotational speed of the coating roller can be kept as low as possible in order to allow as low centrifugal forces as possible to act on the coating absorbed at the coating area. Accordingly, it is advantageous if the circular radius of the coating area designed as a circular cylinder segment is as large as possible and only a small angular range relative to the axis of rotation of the coating roller is occupied by the coating area in order to carry out the rolling movement on the outer surface of the cylindrical hollow body.

It is advantageous if a length of a circular arc determined by the coating region is bigger, preferably at least 10 percent bigger, preferably at least 20 percent bigger, particularly preferably at least 30 percent bigger, in particular at least 40 percent bigger, than a circumference of the holding mandrel. Here it is assumed that an outer diameter of the cylindrical hollow body is only slightly larger than a diameter of the holding mandrel, in particular in the range of less than 1/10 mm, so that the circumference of the holding mandrel almost corresponds to the circumference of the outer surface of the cylindrical hollow body. Due to the fact that the circumference of the coating region is larger than the circumference of the outer surface of the cylindrical hollow body a preferably homogeneous application of the coating to the outer surface of the cylindrical hollow body is achieved.

The invention also provides for the coating roller to be rotatably mounted on the machine frame at a first end area and fixedly coupled to a rotary drive at a second end area. This bearing of the coating roller on both sides favours an advantageous support of the coating roller with regard to the reaction forces which can occur during the coating of cylindrical hollow bodies. This also facilitates the adjustment of a spatial position of the axis of rotation of the coating roller relative to the axis of rotation of the associated mandrel, since the two-sided bearing of the coating roller at the end area facing away from each other along the axis of rotation ensures a stable support for the coating roller. The coating roller is mounted on the machine frame via the coating station fixed to the machine frame, so that a force flow is transferred from the coating roller via the coating station into the machine frame.

It is preferably provided that a cylindrical receiving shaft is formed at the coating station, in which receiving shaft an eccentric sleeve is rotatably accommodated, wherein the rotary drive is accommodated in the eccentric sleeve and the eccentric sleeve may be coupled non-rotatably to the coating station. By receiving the rotary drive, which is preferably provided with a circular cylindrical housing, in the eccentric sleeve, whose bore for receiving the rotary drive has a central axis which does not coincide with a central axis of an outer surface of the eccentric sleeve, an advantageous and sensitive setting of an axial distance for the rotational axis of the rotary drive and the coating roller coupled thereto relative to the rotational axis of the holding mandrel can be ensured in the coating position. In particular, an adjusting equipment is provided for this purpose which is coupled to the eccentric sleeve and to the coating station and is designed for adjusting a rotational position of the eccentric sleeve relative to the coating station.

It is expedient when a cylindrical coating roller which is rotatably mounted at the coating station and is designed for a rolling movement on the coating region of the coating roller is arranged parallel to the coating roller, a coating tank for continuous coating application to the coating roller being assigned to the coating roller. The task of the coating roller is to apply a liquid coating (in particular a radiation, preferably ultraviolet radiation, hardenable coating) as uniformly as possible to the coating area of the coating roller. The coating is stored in the coating tank (which is also referred to as a blade unit) so that the outer surface of the cylindrical hollow body touched by the coating area of the coating roller during the coating process can also be coated as evenly as possible with a constant layer thickness of the coating. As an example, it is provided that the coating roller, which is also referred to as an anilox roller, has an outer surface made of a hard material such as steel or ceramic, in which a multiplicity of small depressions, which are also referred to as anilox depressions, are made, these depressions serving to transport the coating from the coating tank to the coating region of the coating roller. Preferably at least one blade-like scraper strip (squeegee) is provided in the coating tank, which, when the coating roller rotates, strokes over the outer surface of the coating roller and removes the excess coating from the outer surface of the coating roller. Only the coating deposited in the recesses remains on the outer surface of the coating roller, which can be rolled off on the coating area of the coating roller.

In a further configuration of the invention, a further coating station is provided which comprises at least one ink-jet print head which is designed for a freely predeterminable coating of a surface region of a cylindrical hollow body accommodated on a holding mandrel. While the coating region of the coating roller is designed for a uniform paint application or coating application, in particular on the entire outer surface of the cylindrical hollow body, the at least one ink jet print head serves for an individual, freely predeterminable coating, in particular printing, of a surface region of the cylindrical hollow body. It is preferably provided that one or more coating stations equipped with ink jet print heads are arranged on the machine frame of the coating apparatus, which coating stations enable coating, in particular printing, of the outer surface of the cylindrical hollow body with different motifs in different colours.

It is preferably provided that the coating roller has a dimensionally stable, preferably cylindrical, carrier shaft on the outer surface of which an elastic layer is applied, the circumferential surface of which determines the coating region and the free-wheeling region. As an example, the carrier shaft is produced from a metal material or a fibre-reinforced plastic material and provided with a rubber-elastic coating, in particular from the material group EPDM (ethylene-propylene-diene rubber), wherein a material-locking coupling of the elastic layer to the carrier shaft is provided.

It is advantageous if the carrier shaft is penetrated by a longitudinal bore which in each case has a conical shaped widening at each end, in particular extending up to an end face of the carrier shaft. The task of the end widenings is to enable a positive, self-centering coupling with correspondingly designed guide cones which are rotatably mounted at the coating station. An example of this is that one of the guide cones is mounted on the coating station so as to be freely rotatable, while the other guide cone represents an end section of a drive shaft of a rotary drive associated with the coating station. It is advantageous if at least one of the guide cones can be displaced linearly along the axis of rotation for the coating roller to allow insertion or removal of the coating roller in an open position and to allow the desired centring, torque transmission and power transmission between the drive shaft and the coating roller in a functional position.

It is advantageous if a positioning equipment designed as a projection or recess for a torque proof coupling with a drive shaft of a rotary drive is formed on the carrier shaft, in particular in the area of the widening. The positioning equipment can be used in a double function for the (rotationally) correct positioning of the coating roller relative to the drive shaft of the rotary drive. In addition, the positioning equipment can provide at least one surface which is used for torque transmission between the drive shaft of the rotary drive and the carrier shaft and whose surface normal is preferably aligned at least substantially perpendicularly to the axis of rotation of the coating roller. As an example, it can be provided that the positioning equipment is formed as a recess in the region of the widening on the carrier shaft and a corresponding projection is provided on at least one of the guiding cones in order to ensure the desired positioning of the coating roller and the transmission of force and torque between the coating roller, the coating station and the machine frame.

The task of the invention is solved by a process for coating cylindrical hollow bodies. The method comprises the following steps: Carrying out a rotary step movement of a workpiece rotary table with respect to a machine frame to provide a hollow body, which is accommodated on a mandrel, in a coating position opposite to a coating roller and maintaining the coating position for a predeterminable holding period, carrying out a rolling movement of a coating region of the coating roller relative to the rotating hollow body during the holding period, the rolling movement of the coating region of the coating roller relative to the rotating hollow body taking place during a coating period which forms a subset of the holding period. For an advantageous application of a coating to the outer surface of the cylindrical hollow body, a slip-free rolling movement of the coating area of the coating roller relative to the hollow body is desirable. Accordingly, it is provided on the one hand that the hollow body is set into a uniform rotational movement at least immediately before the start of the coating process, a peripheral speed of the rotating hollow body being adapted to a peripheral speed of the coating region of the coating roller, in particular being identical. Furthermore, the coating time period, i.e. the time period within which there is contact between the coating region of the coating roller and the rotating hollow body, is shorter than a holding time period within which the workpiece rotary table does not carry out a rotary step movement but is rather based relative to the machine frame, the hollow body being in the coating position relative to the coating station. Furthermore, in order to avoid undesirable relative movements between the coating roller and the hollow body, it is provided that the coating time span is completely included within the holding time span and thereby forms a partial or subset of the holding time span, the contact between the coating area and the hollow body taking place exclusively during the coating time span.

For example, it can be assumed that a holding time of 1 second is provided from a standstill time of a previous rotary step movement of the workpiece rotary table to an acceleration time of a subsequent rotary step movement of the workpiece rotary table. Within this holding time span, for example, the coating time span can be 0.6 seconds and starts 0.2 seconds after the start of the holding time span and ends 0.2 seconds before the end of the holding time span. This ensures that 0.2 seconds elapse between the time the workpiece rotary table comes to a standstill and the start of the coating process and 0.2 seconds elapse between the end of the coating process and the re-acceleration of the workpiece rotary table. For example, the duration of the rotary step movement, within which the freshly coated hollow body is removed and an uncoated hollow body is provided to the coating station, is also 1 second.

BRIEF DESCRIPTION OF THE DRAWINGS

An advantageous form of the invention is shown in the drawing. Here shows.

DETAILED DESCRIPTION

Figure 1:
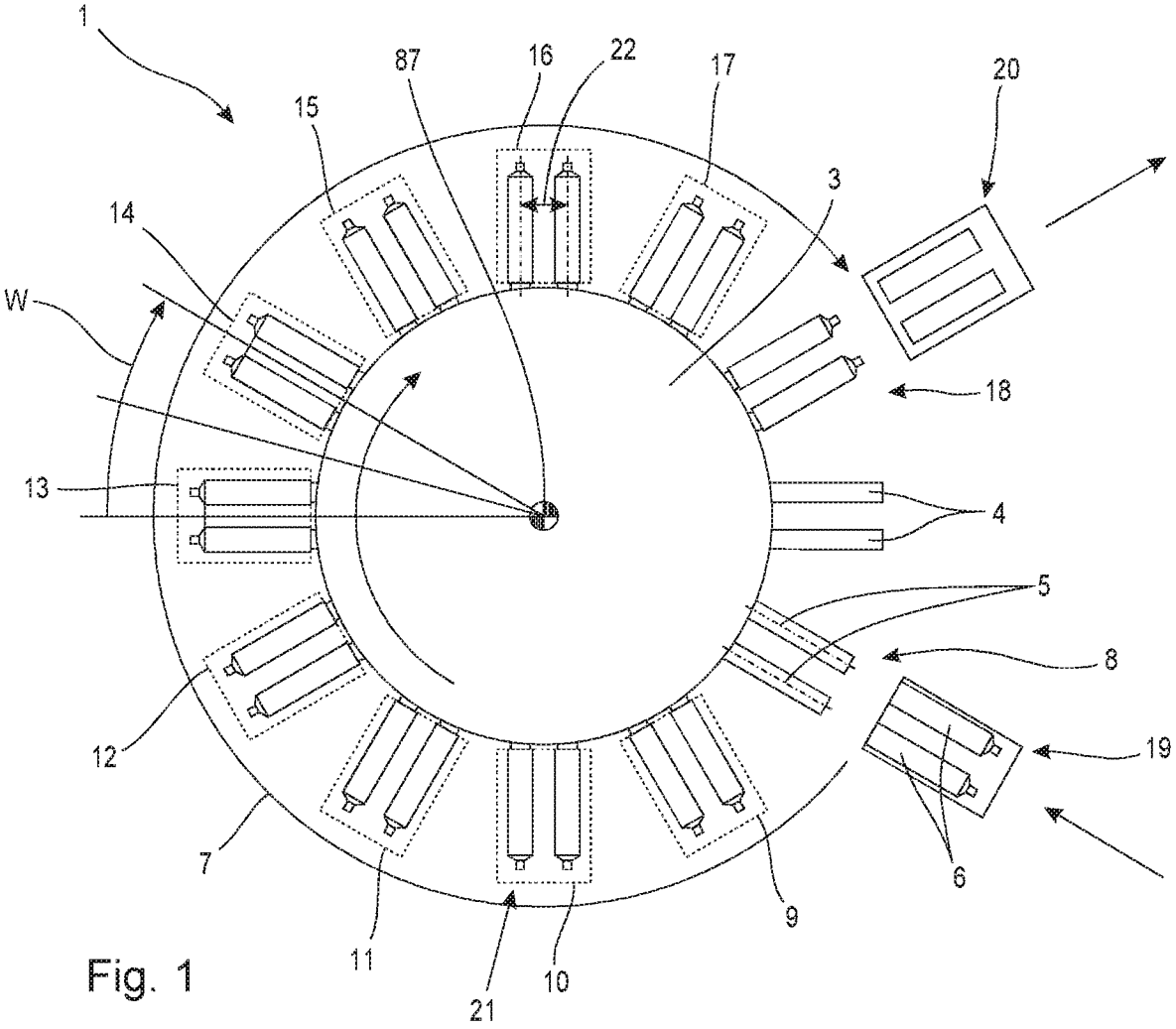
FIG. 1 a schematic overview of a coating apparatus in a plan view.

A coating apparatus 1 shown schematically in FIG. 1 comprises a workpiece rotary table 3 mounted rotatably about a rotation axis 87 aligned perpendicularly to the plane of representation of FIG. 1 on a machine frame which is not shown in more detail, and a plurality of workpiece holders 4 mounted in pairs on the workpiece rotary table 3 as examples. The holding mandrels, afterwards named workpiece holders 4 are individually drivable and mounted rotatably about rotation axes 5 by means of drive means which are not shown. The workpiece holders 4 are provided for receiving sleeve-shaped hollow bodies 6, in particular aerosol can blanks or tube blanks, which are constructed at least essentially with a circular cylindrical cross-section, wherein tube blanks are shown purely exemplarily in FIGS. 1 and 2. The workpiece holders 4 are preferably designed as holding mandrels on which hollow bodies 6, in particular hollow cylinders closed on one side and also referred to as coating objects, can be placed.

As an example, it is provided that adjacent workpiece holders 4 are arranged in pairs in parallel so that two hollow bodies 6 can be provided and removed at work stations 8 and 18 respectively by a linear movement of a transport device 19 and 20 respectively. It is intended that the rotary axes 5 of the workpiece holders 4 should be at a distance of 22 from each other.

As an example, it is assumed that each of the workpiece holders 4 is assigned its own separately electrically controllable drive motor which is not shown and which enables the respective workpiece holder 4 to rotate about the respective axis of rotation 5. This possibility for, in particular, controlled rotation of the respective workpiece holder 4 is used in particular for carrying out the coating process and the coating process described in more detail below.

In an annular section-shaped region which is swept by the workpiece holders 4 during a rotary movement of the workpiece rotary table 3 about the axis of rotation 87, which can be named as movement path 7 and which extends in the circumferential direction around the workpiece rotary table 3, a plurality of work stations 8 to 18 are arranged which are designed for machining and/or inspecting the transported hollow bodies 6. Since the view shown in FIG. 1 is a plan view and the work stations 9 to 17 are arranged above the workpiece holders 4, particularly in the vertical direction, the work stations 9 to 17 are shown only in dotted lines. The function and arrangement of the workstations 8 to 18, some of which are described in more detail below, can be freely selected depending on the intended processing sequence for the hollow bodies 6; workstations with other functions can also be provided or completely omitted.

The work station 8 is a loading station also referred to as a feed station, at which the cylindrical hollow bodies 6 are pushed in pairs onto the workpiece holders 4 by a suitable transport device 19, which is coupled with a conveyor system for the cylindrical objects 6 which is not shown in detail.

At workstation 9, a purely exemplary neutralization of electrical charges is planned, which may be present at an outer surface 25 of the hollow body 6. Such a neutralization is particularly advantageous for hollow bodies 6 made of plastic and may be omitted for hollow bodies 6 made of metal. For the electrical (electrostatic) neutralisation of the hollow bodies 6, the work station 9 comprises a neutralisation arrangement which is not described in detail and with which the discharge of the hollow body 6 can be carried out. As an example, the neutralisation arrangement comprises two electrodes arranged at a distance from one another, to each of which an alternating electric field is applied by a control device which is also not shown in detail. An electric voltage and a frequency of the electric alternating field are matched to the distance between the electrodes in such a way that gas, in particular air, present in the vicinity of the electrodes can be ionised. With the help of the released ions, a charge balance can take place with the electrical charges present on the outer surface 25 of the hollow body 6. The now electrically neutral hollow body 6 is then conveyed along the movement path 7 to the following work station 10.

Downstream along the movement path 7, the work station 10 is provided subsequent to the work station 9, which is purely exemplarily a cleaning arrangement. As an example, the cleaning station is designed as a suction device which is designed for contactless suction of the outer surface 25 of the hollow body 6.

An optical scanning of the cylindrical hollow bodies 6 takes place purely exemplarily at the work station 11 arranged downstream along the movement path 7 to the work station 10 in order to determine a rotational position of the cylindrical hollow bodies 6, for example in order to ensure a correct rotational alignment of the cylindrical hollow bodies 6 for a coating process taking place at the work station 12, in particular a printing process, i.e. a local coating of the hollow body 6 with a predetermined decoration and/or a predetermined inscription. This is particularly important if the outer surface of the hollow body 6 to be coated is provided with features which are to fit in a predetermined manner with a printed image to be applied during this coating. These features may be, for example, a local embossing and/or an embossing into and/or from the outer surface of the hollow body 6 and/or pre-printed areas which in turn are to serve as a primer for the subsequent coating.

Figure 2:
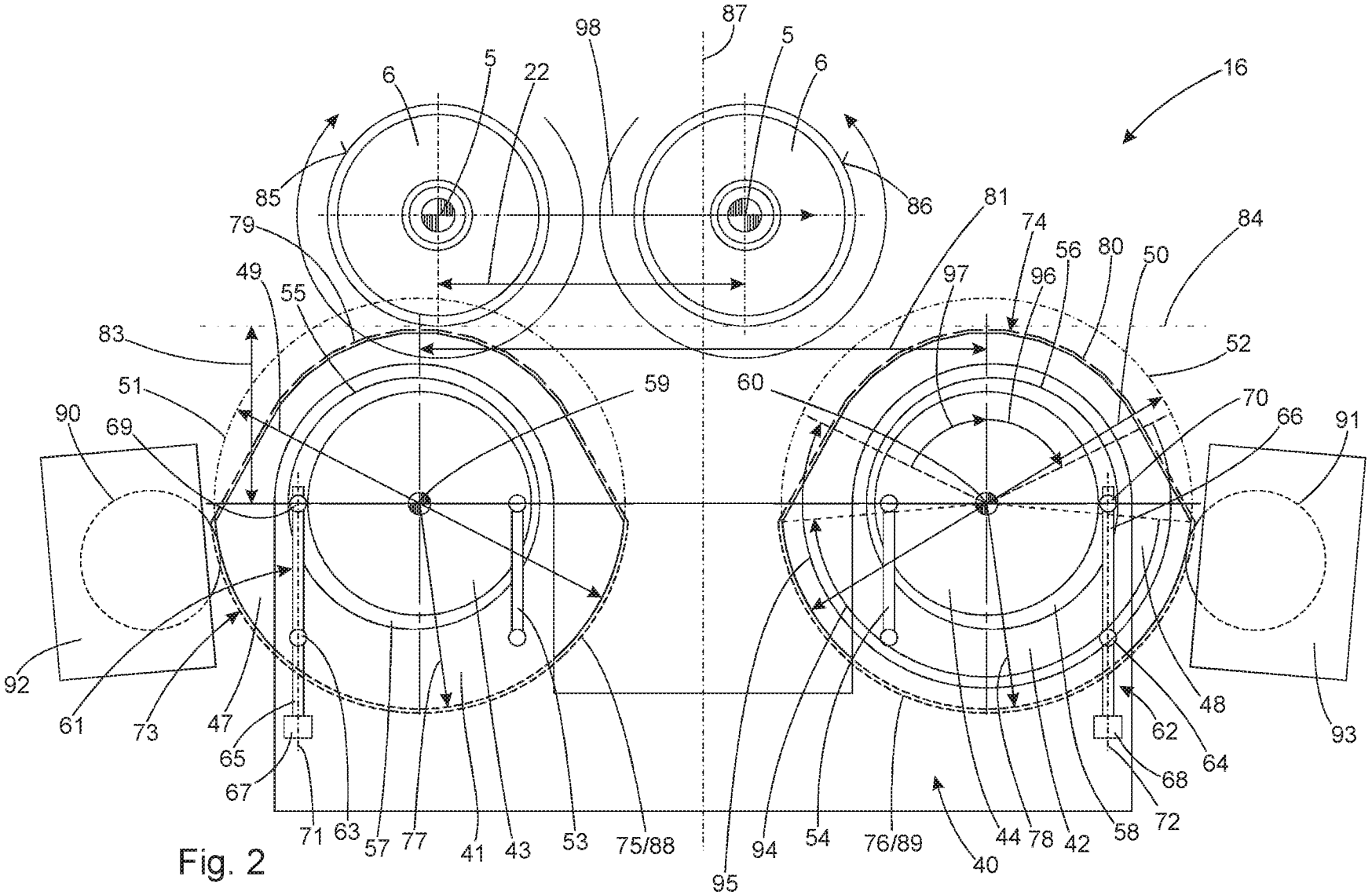
FIG. 2 a schematic overview of a coating station for the coating apparatus according to FIG. 1, FIG. 3 a perspective representation of a coating roller for use in the coating station as shown in FIG. 2, FIG. 4 a front view of the coating roller as shown in FIG. 3, and FIG. 5 a lateral sectional view of the coating roll according to FIG. 4.

The hollow body 6 is now moved in the course of a further rotary step movement of the workpiece rotary table 3 around the rotation axis 87 one after the other to the work stations 12, 13 and 14, which are each designed purely exemplarily as coating stations in order to be coated, in particular printed, there with the aid of coating apparatuses 51, as they are exemplarily shown in FIG. 2. When carrying out the coating process, it is provided that the hollow body 6, which is exemplarily formed with a circular cylindrical cross-section, performs a rotational movement about the axis of rotation 5 shown in FIG. 1 and can be coated or printed during the rotational movement by means of a print head, which is not shown any closer and which is exemplarily an inkjet print head, in particular with an individual decoration. During the coating process, the print head, which is arranged exemplarily at a distance of 1 mm to 5 mm from the outer surface of the hollow body 6 and which is controlled by an print control device (not shown) with electrical signals, emits drops of colour (not shown) from the print head.

The work station 15 arranged downstream of the work station 14 along the movement path 7 is exemplarily designed as an inspection device and makes it possible to determine the coating quality of the printed image applied by the coating station 21 to the circumferential surface of the hollow body 6.

The further work station 16 serves for the further processing of the cylindrical hollow bodies 6 by applying a protective coating to the coating at least on partial surfaces of the hollow body 6. Preferably it is intended that an entire, circular cylindrical outer surface of the respective hollow body 6 is provided with a protective coating.

The following work station 17 has a radiation source (not shown) which is designed for curing the protective coating applied at the work station 16. Preferably, this is a radiation source for ultraviolet radiation.

At work station 18, an unloading process takes place during which the cylindrical hollow bodies 6 are removed from the mandrel-shaped workpiece holders 4 by means of a transport device 20 and fed to a further transport system which is not described in detail.

The workpiece rotary table 4 carries out a rotary step movement around the angle W for the stepwise machining of the cylindrical hollow bodies 6 at the respective work stations 8 to 18, in which the workpiece holders 4 arranged in pairs are transported from a position opposite the respective work stations 8 to 18 to a position opposite the respective subsequent work stations 8 to 18. The rotary step movement takes place as a sequence of acceleration from a standstill, deceleration from the target speed reached and a subsequent holding period. Preferably, an drive (not shown) for the workpiece rotary table 3 is designed in such a way that the acceleration and deceleration of the workpiece rotary table 3 can be freely adjusted over a wide range and the holding time can be adapted to the requirements of the machining of the respective cylindrical hollow bodies 6 at the work stations 8 to 18.

FIG. 2 shows a strongly schematized representation of the work station 16, which is designed as a coating station. FIG. 2 shows only the essential components of the coating station in a front view. The work station 16, which is also referred to below as the coating station 16, comprises purely exemplarily a carrier frame 40, the front area of which is U-shaped only for illustrative reasons, whereby only strictly schematically shown rotary drives 43 and 44, which are exemplarily designed as electric motors, are accommodated on parallel U-arms 41 and 42. Each of the two rotary drives 43 and 44 is provided, for example, with a circular cylindrical motor housing in which a stator which is not shown in detail and a rotor which is also not shown in detail are mounted so that they can rotate relative to one another, the respective rotor being connected to a drive shaft which is also not shown, to the end of which drive shaft a coating roller 47, 48 is coupled so that it cannot rotate relative to the drive shaft. Contrary to the schematic representation in FIG. 2, a diameter of the respective motor housing may alternatively be equal to or larger than a diameter 49, 50 of an envelope 51, 52 around the respective coating roller 47, 48.

As can be seen from FIG. 2, the respective rotary actuator 43, 44 is connected to the carrier frame 40 via a coupling rod 53, 54, whereby the respective coupling rods 53, 54 serve as torque supports for the respective rotary actuators 43, 44. An eccentric sleeve 57, 58 is arranged between the rotary drive 43, 44 and a circular cylindrical recess 55, 56 in the carrier frame 40 for each of the rotary drives 43 and 44, which eccentric sleeve 57, 58 makes it possible to change a spatial position of the rotary axis 59, 60 of the rotary drives 43 and 44, respectively, which is aligned perpendicularly to the representation plane of FIG. 2. Each of the eccentric sleeves 57, 58 is assigned an adjusting device 61, 62 for this purpose, which comprises, purely as an example, a threaded rod 65, 66 which is mounted in a bearing journal 63, 64 on the carrier frame 40 in a rotationally movable and linear manner and which is provided at one end region with an actuating knob 67, 68 for the manual initiation of a rotational movement. At the opposite end area, the respective threaded rod 65, 66 is received in a rotationally movable manner in the associated eccentric sleeve 57, 58 and provided with an adjusting pin 69, 70 corresponding to the threaded rod 65, 66. When the threaded spindle 65, 66 rotates about its longitudinal axis 71, 72, the local position of the threaded rod 65, 66 with respect to the bearing journal 63, 64 does not change, while due to the screw movement of the threaded rod 65, 66 in the respectively associated adjusting journal 69, 70 a change in distance occurs between the bearing journal 63 or 64 and the respectively associated adjusting journal 69 or 70. This results in a change of the rotary position of the respective eccentric sleeve 57, 58 and thus allows the desired spatial displacement of the rotary axis 59, 60 for the respective rotary drive 43 or 44 in order to set a distance from a plane of movement 84 described in more detail below. Such a spatial displacement of the rotary axes 59, 60 of the respective rotary drives 43 or 44 is accompanied by a change in the distance 81 between the rotary axes 59, 60, which, however, is always bigger than the distance 22 between the rotary axes 5 of the workpiece holders 4. Further adjustment possibilities for a change, in particular a tilting, of the spatial position of the respective rotary axes 59, 60 relative to the carrier frame 40 and the hollow bodies 6 can be provided additionally or alternatively, but are not described in detail for reasons of clarity. Alternatively, it may be provided that the eccentric arrangement described above is used in a modified form for setting the contact pressure of the coating rollers 47, 48 with respect to a coating roller 90, 91 described in more detail below and that a spatial displacement of the rotary axis 59, 60 for the respective rotary drive 43 or 44 for distance setting with respect to the plane of movement 84 is effected by means of a linear drive, in particular a threaded spindle drive.

The coating rollers 47 and 48 each have a circumferential surface 73, 74, which is drawn in dashed form in the illustration of FIG. 2 and which is profiled deviating from the circular envelope curve 51, 52 along the axis of rotation 59, 60 of the respective coating roller 47, 48, which is aligned perpendicular to the illustration plane of FIG. 2. The respective circumferential surface 73, 74 is divided into a coating area 75, 76, which is formed as a circular cylinder segment with a constant circular radius 77, 78 coaxial to the axis of rotation 59, 60 of the respective coating roller 47, 48 and in a free-wheeling region 79, 80, which is formed from one or more surface sections (which are not shown in detail). For example, the surface sections of the free-wheeling regions 79, 80 each have a distance to the axis of rotation 59, 60 of the respective coating roller 47, 48 which is smaller than the radius of the circle 77, 78.

The two coating rollers 47, 48 are arranged on the carrier frame 40 in such a way that their axes of rotation 59, 60 each have an identical distance 83 to a plane of movement 84. The movement plane 84 is determined by the outer surfaces 85, 86 of the hollow body 6 by its pivoting movement about the axis of rotation 87 of the workpiece rotary table shown in FIG. 2 and is purely exemplary that circular ring surface which corresponds to a minimum distance of the outer surfaces 85, 86 of the hollow body 6, for example, from the coating station 16.

The distance 83 is dimensioned in such a way that the two coating rollers 47, 48 do not intersect the plane of movement 84 at least over a partial area of their respective free-wheeling regions 79, 80, so that the pivoting movement of the hollow bodies 6 about the axis of rotation 87 can be carried out in the plane of movement 84 without contact taking place with the respective coating rollers 47, 48 in this case.

On the other hand, in the rest position of the workpiece rotary table, which corresponds to a coating position for the hollow bodies 6 opposite the coating rollers 47, 48 which is not shown in more detail, a contact between the respective coating area 75, 76 and the outer surface 85, 86 of the respective hollow body is possible by a respective counter-rotating rotational movement of the hollow body 6 and the associated coating roller 47, 48. With this contact, which takes place during a rolling movement that is as slip-free as possible (synonymous with identical and uniform circumferential speeds for the hollow bodies 6 and the respective coating rollers 47, 48), a coating is applied to the outer surface 85, 86 of the respective hollow body 6.

In particular, it is provided that a length of a circular arc 88, 89 determined by the respective coating area 75, 76 is bigger than a circumference of the respective outer surface 85, 86 of the hollow body 6, so that complete wetting of the outer surface 85, 86 of the hollow body 6 with the coating can take place, which coating can be provided by the respective coating roller 47, 48 in the respective coating area 75, 76.

For the supply of the coating with the help of the respective coating rollers 47, 48, each of the coating rollers 47, 48 is assigned a coating transfer roller 90, 91, which is also referred to as an anilox roller and which is accommodated in a coating tank 92, 93, which is filled with liquid coating in an unspecified manner, in each case area and in rotation. The task of the coating transfer roller 90, 91 is to apply the liquid coating present in the coating tank 92, 93 to the coating area 75, 76 of the respective coating roller 47, 48. For this purpose, blade-like doctor blades are arranged in the coating tank 92, 93, which are not shown in detail, which wipe off the excess coating from the surface of the respective coating transfer roller 90, 91 and thus ensure a transfer of an exactly predeterminable coating quantity from the respective coating transfer roller 90, 91 to the assigned coating roller 47, 48.

In order to prevent the coating transfer rollers 90, 91 and the associated coating rollers 47, 48 from drying out, it is preferably provided that the coating transfer rollers 90, 91 and the coating rollers 47, 48 rotate permanently, in particular at constant circumferential speeds, in deviation from the intermittent rotary step movement of the workpiece rotary table. A synchronization of these rotary movements for the coating rollers 47, 48 with the hollow bodies 6 provided in the course of the rotary step movement of the workpiece rotary table in the coating position not described in more detail below, described in more detail, enables the desired coating application to the outer surface 85, 86 of the hollow bodies 6.

As an example, it is provided that a holding period for the rotary step movement of the workpiece rotary table about the axis of rotation 87 is so dimensioned that during this rest phase of the workpiece rotary table a complete and in particular slip-free rolling movement of the respective coating areas 75, 76 on the outer surfaces 85, 86 of the hollow body 6 can take place. Accordingly, a coating time span for the contact between the coating areas 75, 76 and the outer surfaces 85, 86 is smaller than the holding time span and is completely included in the holding time span.

It is preferably provided that during a rotary step movement for the workpiece rotary table 3, within each of which two hollow bodies 6 are conveyed into the sphere of influence of the coating station 16 and removed again from the sphere of influence of the coating station 16, the rotary step movement of the workpiece rotary table comes to a standstill and this period of the standstill is referred to as the holding period. During this holding period, the outer surfaces 85, 86 of the hollow bodies 6 are coated.

With respect to the preferably constant rotation of the respective coating rollers 47, 48 about the rotation axes 59, 60, the coating time span can be represented by the angle 94 and the holding time span by the angle 95, while the angles 96 and 97 represent the feed of the hollow bodies 6 during the rotary step movement before the holding time span and the removal of the hollow bodies 6 during the rotary step movement after the holding time span, respectively.

Accordingly, FIG. 2 shows that the hollow bodies 6 are not yet in the coating position not shown, in which the hollow bodies 6 are aligned symmetrically to the axis of rotation 87 in particular. Rather, the hollow bodies 6 are still in the infeed transport, as indicated by the movement arrow 98.

As soon as the hollow bodies 6 have reached the coating position which is not shown closer, symmetrically to the axis of rotation 87, the holding period represented by the angle 95 begins, within which the coating period represented by the angle 94 is then included, the contact between the coating areas 75 and 76 with respect to the hollow bodies 6 taking place exclusively during the coating period.

Figure 3:
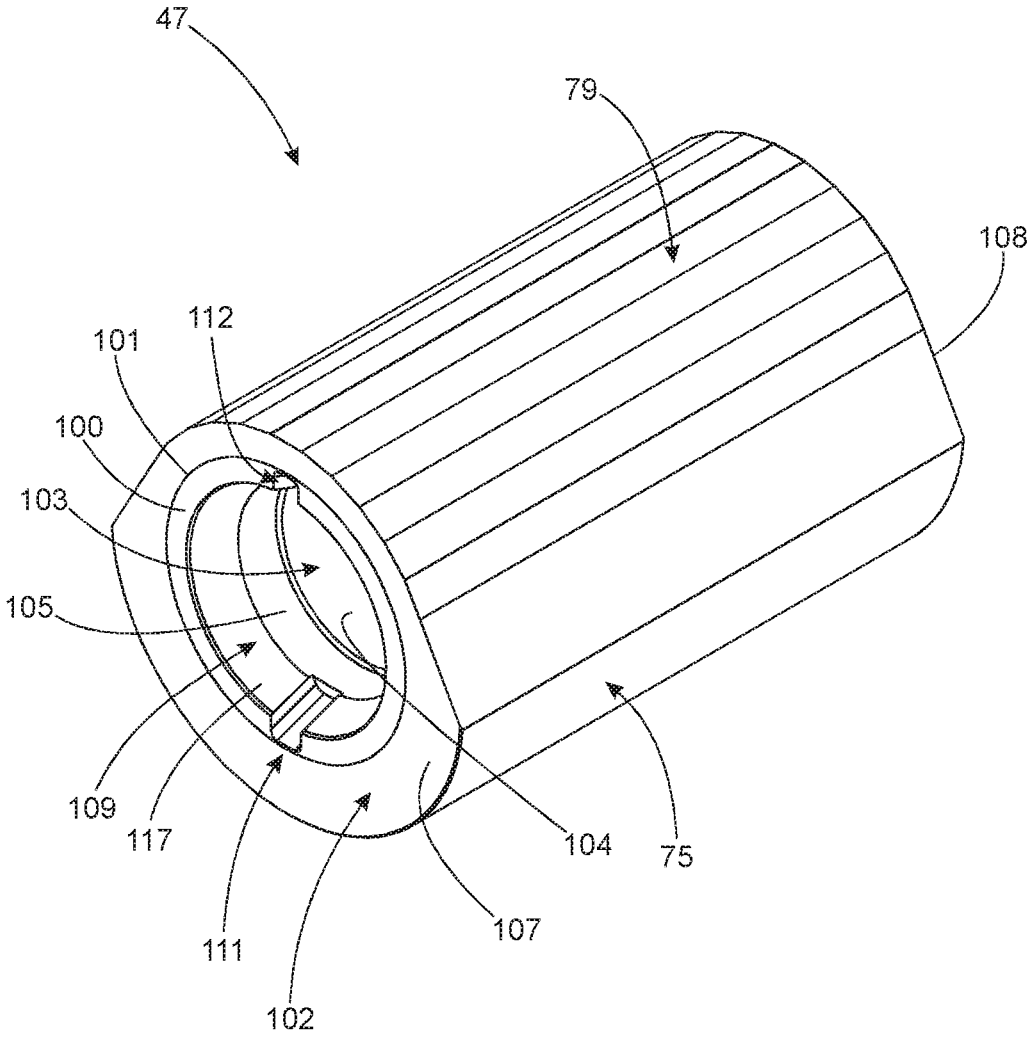
Figure 4:
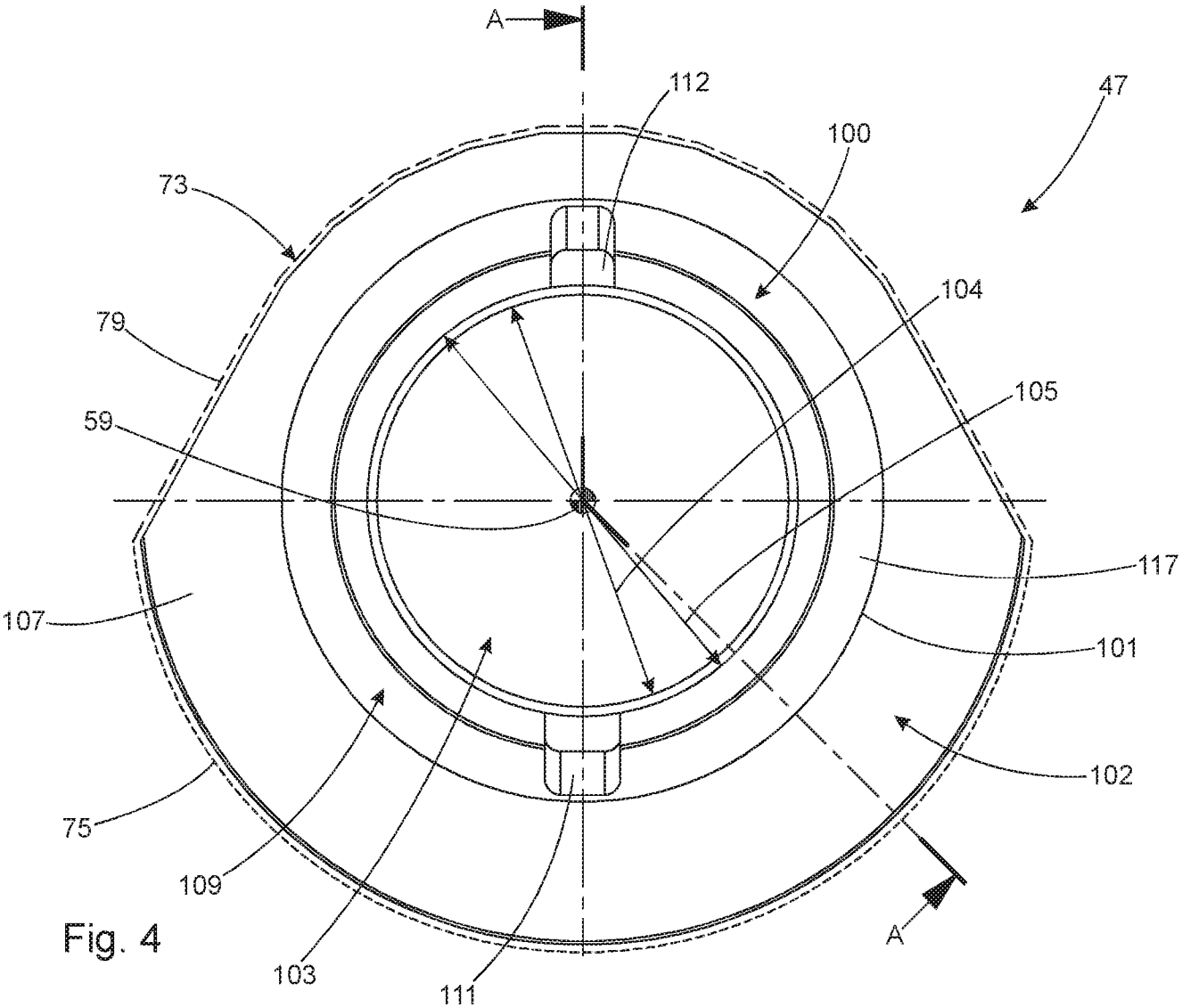
Figure 5:
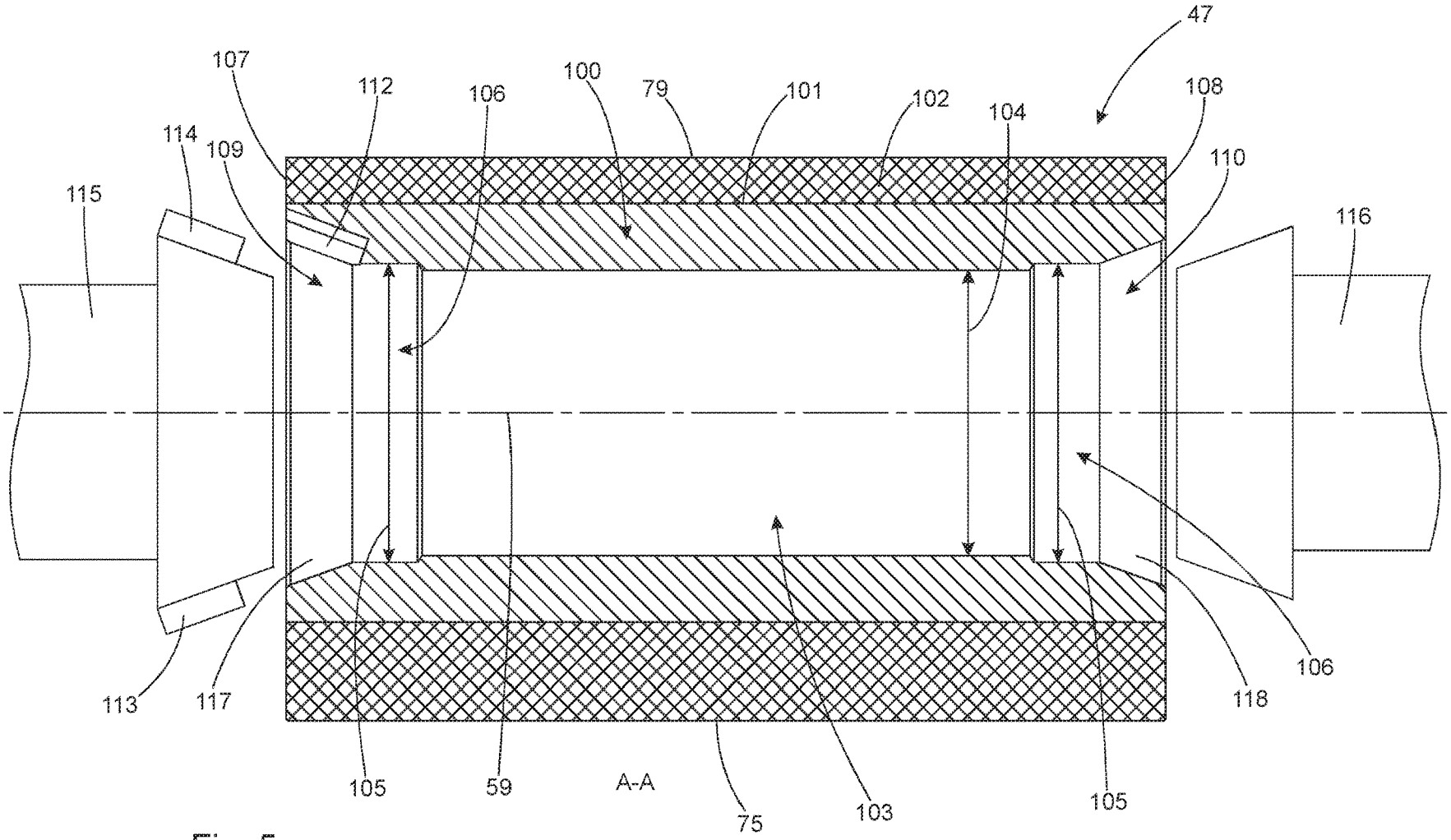

The structure and geometry of the coating roller 47 (and in the same way the coating roller 48) are shown in FIGS. 3 to 5. As can be seen, for example, from the sectional view of FIG. 5, the coating roller 47 comprises a dimensionally stable carrier shaft 100, which is purely exemplary and as far as possible rotationally symmetrical to the axis of rotation 59 and which can be made, for example, of a fibre-reinforced plastic or of metal, in particular steel. An elastic layer 102 is applied to an outer cylinder surface 101 of the carrier shaft 100, which is preferably bonded to the outer cylinder surface 101 and is, for example, made of EPDM. A profile of the elastic layer 102 along the rotational axis 59, also referred to as the longitudinal axis, can be seen in FIG. 4 and comprises the coating area 75 and the free-wheeling region 79.

The carrier shaft 100 is interspersed with a rotationally symmetrical longitudinal bore 103, which has a first diameter of 104 in a central area and a second diameter of 105 adjacent and stepped to it at the ends, each of which defines a cylinder bore section 106. The cylinder bore section 106 is adjoined at each end by a conical section-shaped widening 109, 110 which extends to an end face 107, 108. In the widening 109 two oppositely arranged recesses 111 and 112 are formed as examples, which have a different width according to the illustration in FIG. 4 and thus ensure a clear geometrical assignment to projections 113, 114 of a drive shaft 115 of a rotary drive 43, which is only schematically shown.

The widening 110 arranged at the opposite end face 108 is preferably exclusively cone-shaped and is intended for planar contact with a bearing cone 116, which is mounted on the carrier frame 40 in a rotationally movable manner and is shown only schematically in FIG. 5 and in no more detail. Preferably it is provided that either the bearing cone 116 or the rotary drive 43 not shown in FIG. 5 with its drive shaft 115 can be moved linearly along the axis of rotation 59. In this way, in a release position, as indicated in FIG. 5, the coating roller 47 can be replaced and in a functional position not shown, in which both the drive shaft 115 and the bearing cone 116 rest against cone surfaces 117, 118 of the widenings 109, 110, a rotary bearing for the coating roller 47 can be ensured. This rotary bearing is preferably configured so that axial forces along the axis of rotation 59 and radial forces transverse to the axis of rotation 59 can be transmitted from the coating roller 47 to the drive shaft 115 and the bearing cone 116 and a drive torque can be initiated from the drive shaft 115 via the projections 113 and 114 and the associated recesses 111 and 112 to initiate the rotary movement of the coating roller 47 about the axis of rotation 59.

What is claimed is:

1. A coating apparatus for coating cylindrical hollow bodies, having a machine frame and a workpiece rotary table which is mounted on the machine frame so as to be rotatable about an axis of rotation and which is equipped with a plurality of holding mandrels which are each rotatably mounted on the workpiece rotary table and which are configured to receive cylindrical hollow bodies, and with a coating station arranged on the machine frame for receiving the holding mandrels, wherein the coating station comprises a coating roller which is rotatably mounted on the coating station, wherein an axis of rotation of each of the holding mandrels received in the coating station and an axis of rotation of the coating roller are aligned parallel to one another, the coating roller having a coating region and a free-wheeling region on a circumferential surface, the coating region being a circular cylinder segment with a constant circular radius and is coaxial with the rotational axis of the coating roller and wherein the free-wheeling region is formed from surface sections which each have a distance from the rotational axis of the coating roller which is smaller than the circular radius so that the free-wheeling region of the coating roller does not contact the cylindrical hollow bodies upon rotation of the coating roller.

2. The coating apparatus according to claim 1, wherein the axes of rotation of the holding mandrels and the axis of rotation of the coating roller are aligned transversely to the axis of rotation of the workpiece rotary table.

3. The coating apparatus according to claim 2, wherein holding mandrels arranged in pairs adjacent in each case on the workpiece rotary table are aligned parallel to one another, and wherein the coating station comprises two coating rollers aligned parallel to one another, each of the coating rollers being aligned opposite one of the two holding mandrels in a coating position of the workpiece rotary table.

4. The coating apparatus according to claim 3, wherein a distance between the axis of rotation of each of the holding mandrels arranged in pairs is smaller than a distance between the axis of rotation of the coating rollers aligned parallel to one another.

5. The coating apparatus according to claim 1, wherein the coating region of the coating roller covers an angular region of less than 270 degrees of the coating roller.

6. The coating apparatus according to claim 1, wherein the coating region of the coating roller defines a circular arc having a length, and wherein the length of the circular arc is bigger than a circumference of each of the holding mandrels.

7. The coating apparatus according claim 1, wherein the coating roller is mounted rotatably on the machine frame at a first end region and is coupled non-rotatably to a rotary drive at a second end region.

8. The coating apparatus according to claim 7, wherein a circular cylindrical receiving shaft is formed at the coating station, in which receiving shaft an eccentric sleeve is rotatably accommodated, the rotary drive being rotatably accommodated in the eccentric sleeve and being coupled non-rotatably to the coating station.

9. The coating apparatus according to claim 8, wherein an adjusting device is coupled to the eccentric sleeve and to the coating station and is designed for adjusting a rotational position of the eccentric sleeve with respect to the coating station.

10. The coating apparatus according to claim 1, wherein, parallel to the coating roller, there is arranged a coating roller which is mounted rotatably movably on the coating station and has a circular cylindrical shape, which is designed for a rolling movement on the coating area of the coating roller, wherein a coating tank for a continuous coating application to the coating roller is assigned to the coating roller.

11. The coating apparatus according to claim 1, wherein a further coating station is provided which comprises at least one ink jet print head which is configured for a freely predeterminable coating of a surface region of a cylindrical hollow body accommodated on each of the holding mandrels.

12. The coating apparatus according to claim 1, wherein the coating roller has a dimensionally stable carrier shaft on the outer surface of which an elastic layer is applied, the circumferential surface of which determines the coating region and the free-wheeling region.

13. The coating apparatus according to claim 12, wherein the carrier shaft is penetrated by a longitudinal bore which in each case has a conical section-shaped widening at the end.

14. The coating apparatus according to claim 12, wherein, on the carrier shaft, there is formed a positioning equipment in the form of a projection or a depression for a rotationally fixed coupling with a drive shaft of a rotary drive.

15. A method for coating cylindrical hollow bodies comprising the steps of:

providing a coating apparatus having a machine frame and a workpiece rotary table which is mounted on the machine frame so as to be rotatable about an axis of rotation and which is equipped with a plurality of holding mandrels which are each mounted on the workpiece rotary table so as to be rotatable and are configured to receive cylindrical hollow bodies, and with a coating station arranged on the machine frame for receiving the holding mandrels, wherein the coating station comprises a coating roller mounted so as to be rotatable, wherein an axis of rotation of each of the holding mandrels received in the coating station and an axis of rotation of the coating roller are aligned parallel to one another, the coating roller having a coating region and a free-wheeling region on a circumferential surface, the coating region being a circular cylinder segment with a constant circular radius is coaxial with the rotational axis of the coating roller and wherein the free-wheeling region is formed from surface sections which each have a distance from the rotational axis of the coating roller which is smaller than the circular radius so that the free-wheeling region of the coating roller does not contact the cylindrical hollow bodies upon rotation of the coating roller, wherein the method comprises:

performing a rotary step movement of the workpiece rotary table relative to the machine frame to provide at least one of the hollow bodies received on a holding mandrel in a coating position opposite the coating roller;

maintaining the coating position for a predeterminable holding period; and performing a rolling movement of the coating region of the coating roller relative to the at least one of the rotating hollow bodies during the holding period, wherein the rolling movement of the coating region of the coating roller relative to the at least one of the rotating hollow bodies takes place during a coating period occurring during the holding period.

* * * * *